US010737824B2

(12) United States Patent
Fitzwater et al.

(10) Patent No.: US 10,737,824 B2
(45) Date of Patent: Aug. 11, 2020

(54) RECONFIGURABLE CARTON AND PACKAGE

(71) Applicant: Graphic Packaging International, Inc., Atlanta, GA (US)

(72) Inventors: Kelly R. Fitzwater, Lakewood, CO (US); Raymond S. Kastanek, Mead, CO (US)

(73) Assignee: Graphic Packaging International, LLC, Atlanta, GA (US)

( * ) Notice: Subject to any disclaimer, the term of this patent is extended or adjusted under 35 U.S.C. 154(b) by 213 days.

(21) Appl. No.: 15/811,819

(22) Filed: Nov. 14, 2017

(65) Prior Publication Data

US 2018/0134439 A1 May 17, 2018

Related U.S. Application Data

(60) Provisional application No. 62/421,575, filed on Nov. 14, 2016.

(51) Int. Cl.
*B65D 5/355* (2006.01)
*B65D 33/02* (2006.01)
(Continued)

(52) U.S. Cl.
CPC ..... *B65D 5/0005* (2013.01); *B65D 5/02* (2013.01); *B65D 5/4266* (2013.01); *B65D 5/541* (2013.01);
(Continued)

(58) Field of Classification Search
CPC .... B65D 5/60; B65D 81/3469; B65D 5/0005; B65D 5/02; B65D 5/541; B65D 2581/3471; B65D 5/4266; B65D 33/02; B65D 3/36
(Continued)

(56) References Cited

U.S. PATENT DOCUMENTS 499,655 A 6/1893 Clark
642,121 A 1/1900 Hildreth
(Continued)

FOREIGN PATENT DOCUMENTS

CA 2 629 426 6/2007
CA 2629426 6/2007
(Continued)

OTHER PUBLICATIONS

International Search Report and Written Opinion for PCT/US2017/061425 dated Feb. 26, 2018.
(Continued)

*Primary Examiner* — Nathan J Newhouse
*Assistant Examiner* — Matthew T Theis
(74) *Attorney, Agent, or Firm* — Womble Bond Dickinson (US) LLP

(57) ABSTRACT

A carton for holding a product in a liner. The carton includes a plurality of panels extending at least partially around an interior of the carton, the plurality of panels including a front panel, at least one rear panel, and at least one side panel. At least one end flap is foldably connected to a respective panel of the plurality of panels. The at least one side panel includes at least one expansion feature for transitioning the carton between a first configuration and a second configuration. The at least one expansion feature is foldably connected to the front panel and the at least one rear panel.

34 Claims, 10 Drawing Sheets

(51) Int. Cl.

| | |
|---|---|
| ***B65D 5/02*** | (2006.01) |
| ***B65D 5/42*** | (2006.01) |
| ***B65D 5/54*** | (2006.01) |
| ***B65D 5/60*** | (2006.01) |
| ***B65D 81/34*** | (2006.01) |

(52) U.S. Cl.
CPC ..... *B65D 5/60* (2013.01); *B65D 33/02* (2013.01); *B65D 81/3469* (2013.01); *B65D 2581/3471* (2013.01)

(58) Field of Classification Search
USPC ..... 229/101, 117.27–117.35
See application file for complete search history.

(56) References Cited

U.S. PATENT DOCUMENTS 1,138,469 A 5/1915 Goodkind
1,145,668 A 7/1915 Brown
1,478,791 A 12/1923 Nelson
1,503,161 A 7/1924 Hornecker
1,564,374 A 12/1925 Smith
1,634,073 A 6/1927 Labombarde
1,656,919 A 1/1928 Marsh
1,762,703 A 6/1930 Smith
1,762,704 A 6/1930 Smith
1,772,625 A 8/1930 Caulfield
1,844,751 A 2/1932 Fink et al.
1,869,751 A 8/1932 Iacobitti
1,901,483 A 3/1933 Ware, Jr.
1,911,215 A 5/1933 Walter
1,925,102 A 9/1933 Levkoff
1,951,408 A 3/1934 Haven
1,971,863 A 8/1934 Lupton
2,005,924 A 6/1935 Wilson
2,006,203 A 6/1935 Leslie
2,027,079 A 1/1936 Weiss
2,077,341 A 4/1937 Martin et al.
2,098,818 A 11/1937 Andrews
2,141,743 A 12/1938 Ethridge
2,145,430 A 1/1939 New
2,152,079 A 3/1939 Mott
2,196,243 A 4/1940 Bensel
2,251,283 A 8/1941 Johnson
2,290,971 A 7/1942 King
2,292,573 A 8/1942 Kondolf
2,330,294 A 9/1943 Leavitt et al.
2,335,913 A 12/1943 Buttery
2,337,892 A 12/1943 Hultin
2,343,222 A 2/1944 Nelson
2,345,486 A 3/1944 Leebov
2,346,134 A 4/1944 Kirkland et al.
2,348,377 A 5/1944 Goodyear
2,355,665 A 8/1944 Mabee
2,365,159 A 12/1944 Walton
2,383,853 A 8/1945 Guyer
2,407,781 A 9/1946 Guyer
2,407,802 A 9/1946 Stotter
2,416,332 A 2/1947 Lehman
2,437,926 A 3/1948 Ball
2,502,117 A 3/1950 Anderson
2,576,594 A 11/1951 Goldstein
2,594,394 A 4/1952 Casselman
2,643,589 A 6/1953 Weiss
2,679,349 A 5/1954 Mullinix
2,701,679 A 2/1955 Goldstein
2,706,076 A 4/1955 Guyer
2,710,134 A 6/1955 Schroeder et al.
2,775,393 A 12/1956 Rugg
2,778,557 A 1/1957 Moore
2,791,362 A 5/1957 Nute
2,810,506 A 10/1957 Kessler
2,848,151 A 8/1958 O'Neil
2,868,433 A 1/1959 Anderson, Jr.
2,875,938 A 3/1959 Bramhill
2,933,228 A 4/1960 Guyer
2,934,251 A 4/1960 Kramer
2,944,726 A 7/1960 McCauley
2,955,739 A 10/1960 Collura
2,967,610 A 1/1961 Ebert et al.
2,973,086 A 2/1961 Ball
2,993,632 A 7/1961 De Feo
3,002,613 A 10/1961 Merkel et al.
3,006,165 A 10/1961 Mittelberger
3,013,712 A 12/1961 Wollaeger
3,021,002 A 2/1962 Guyer
3,033,362 A 5/1962 Marcalus
3,048,324 A 8/1962 Anderson
3,090,483 A 5/1963 Algree et al.
3,092,301 A 6/1963 Selle
3,094,266 A 6/1963 Hoff
3,112,856 A 12/1963 MacIntosh et al.
3,116,866 A 1/1964 Boran
3,137,437 A 6/1964 Svensson
3,157,342 A 11/1964 Grady
3,158,312 A 11/1964 Simkins
3,159,326 A 12/1964 Stonebanks
3,180,556 A 4/1965 Asman
3,184,136 A 5/1965 Forbes, Jr.
3,185,374 A 5/1965 Feeney
3,189,251 A 6/1965 McFarland
3,265,283 A 8/1966 Farquhar
3,276,665 A 10/1966 Rasmussen
3,276,671 A 10/1966 Fleitman
3,280,968 A 10/1966 Craine
3,291,372 A 12/1966 Saidel
3,355,089 A 11/1967 Champlin
3,363,422 A 1/1968 Maulini et al.
3,363,822 A 1/1968 Maulini et al.
3,414,182 A 12/1968 Fobiano
3,417,911 A 12/1968 Hennessey
3,426,955 A 2/1969 Olson
3,434,648 A 3/1969 Du Barry, Jr.
3,443,971 A 5/1969 Wood
3,533,807 A 10/1970 Wakefield
3,561,667 A 2/1971 Saltman
3,578,234 A 5/1971 Marchisen
3,621,628 A 11/1971 Chidsey, Jr.
3,640,447 A 2/1972 Forbes, Jr. et al.
3,653,495 A 4/1972 Gray
3,669,345 A 6/1972 Cole
3,677,458 A 7/1972 Gosling
3,680,766 A 8/1972 Collura et al.
3,690,544 A 9/1972 Meyers
3,744,702 A 7/1973 Ellison
3,750,538 A 8/1973 Confer
3,759,378 A 9/1973 Werth
3,768,719 A 10/1973 Johnson
3,786,914 A 1/1974 Beutler
3,831,836 A 8/1974 Ellison et al.
3,880,341 A 4/1975 Bamburg et al.
3,884,348 A 5/1975 Ross
3,886,901 A 6/1975 Zeitter
3,891,137 A 6/1975 Ellison et al.
3,905,646 A 9/1975 Brackmann et al.
3,951,333 A 4/1976 Forbes, Jr. et al.
3,981,430 A 9/1976 Keim
4,008,849 A 2/1977 Baber
4,015,768 A 4/1977 McLennan
4,027,794 A 6/1977 Olson
4,036,423 A 7/1977 Gordon
4,046,307 A 9/1977 Booth et al.
4,059,220 A 11/1977 Lorenz
4,095,735 A 6/1978 Stone
4,113,100 A 9/1978 Soja et al.
4,141,485 A 2/1979 Lambert
4,151,946 A 5/1979 Schmidt et al.
4,165,030 A 8/1979 Bunger et al.
4,168,003 A 9/1979 Wysocki
4,194,677 A 3/1980 Wysocki
4,308,956 A 1/1982 Steinke et al.
4,328,923 A 5/1982 Graser
4,341,338 A 7/1982 Arnold
4,344,537 A 8/1982 Austin

(56) References Cited

U.S. PATENT DOCUMENTS 4,345,393 A 8/1982 Price et al.
4,371,109 A 2/1983 Tanner et al.
4,378,905 A 4/1983 Roccaforte
4,380,314 A 4/1983 Langston, Jr. et al.
4,448,309 A 5/1984 Roccaforte et al.
4,453,665 A 6/1984 Roccaforte et al.
4,458,810 A 7/1984 Mahoney
4,484,683 A 11/1984 Werner, Jr.
4,498,619 A 2/1985 Roccaforte
4,508,218 A 4/1985 Focke et al.
4,512,476 A 4/1985 Herrington, Jr.
4,519,538 A 5/1985 Omichi
4,546,914 A 10/1985 Roccaforte
4,548,318 A 10/1985 Boyle
4,558,785 A 12/1985 Gordon
4,566,593 A 1/1986 Muller
4,572,423 A 2/1986 Spencer
4,584,202 A 4/1986 Roccaforte
4,586,643 A 5/1986 Halabisky et al.
4,586,649 A 5/1986 Webinger
4,588,084 A 5/1986 Holley, Jr.
4,602,735 A 7/1986 Aaron
4,608,038 A 8/1986 Virta et al.
4,621,736 A 11/1986 Roccaforte
4,645,108 A 2/1987 Gavin et al.
4,676,394 A 6/1987 Hiersteiner
4,706,876 A 11/1987 Wilson
4,734,288 A * 3/1988 Engstrom ..... B65D 81/3453
156/275.7
4,742,917 A 5/1988 Bornwasser et al.
4,746,019 A 5/1988 Prater
4,752,029 A 6/1988 Buford
4,760,952 A 8/1988 Wachter et al.
4,768,703 A 9/1988 Sosler et al.
4,773,541 A 9/1988 Riddell
4,778,057 A 10/1988 Allen et al.
4,781,317 A 11/1988 Ditto
4,793,550 A 12/1988 Gottlieb
4,804,138 A 2/1989 McFarland
4,815,609 A 3/1989 Kiedaisch
4,863,052 A 9/1989 Lambert
4,865,187 A 9/1989 Zulauf et al.
4,886,160 A 12/1989 Kligerman
4,905,898 A 3/1990 Wade
4,909,395 A 3/1990 Weissman
4,911,177 A 3/1990 Lamb et al.
4,913,292 A 4/1990 Field
4,919,269 A 4/1990 Wright et al.
4,946,093 A 8/1990 Moorman
4,946,540 A 8/1990 Mitchard
4,948,033 A 8/1990 Halsell et al.
4,974,771 A 12/1990 Lavery
4,989,735 A 2/1991 O'Brien
5,012,959 A 5/1991 Gordon
5,020,337 A 6/1991 Krieg
5,050,742 A 9/1991 Muckenfuhs
5,069,359 A 12/1991 Liebel
5,071,010 A 12/1991 Carufel/Zeman
5,072,876 A 12/1991 Wilson
5,083,667 A 1/1992 Holder
5,092,516 A 3/1992 Kastanek
5,094,359 A 3/1992 DeMars et al.
5,125,568 A 6/1992 Bauer
5,129,875 A 7/1992 Chaygneaud-Dupuy
5,141,150 A 8/1992 Plaessmann
5,170,934 A 12/1992 Lemoine
5,181,650 A 1/1993 Hollander et al.
5,222,660 A 6/1993 Koss
5,238,181 A 8/1993 Mahler
5,251,808 A 10/1993 Rudd
5,285,956 A 2/1994 Piepho
5,292,058 A 3/1994 Zoss et al.
5,307,986 A 5/1994 Schuster
5,328,091 A 7/1994 Koss
5,347,865 A 9/1994 Mulry et al.
5,356,022 A 10/1994 Tipps
5,373,960 A 12/1994 Gunn et al.
5,386,937 A 2/1995 Crawford
5,429,297 A 7/1995 Walsh
5,450,680 A 9/1995 Bromberg
5,472,090 A 12/1995 Sutherland
5,495,727 A 3/1996 Strong et al.
5,505,372 A 4/1996 Edson et al.
5,544,806 A 8/1996 Anderson et al.
5,551,566 A 9/1996 Sutherland
5,551,938 A 9/1996 Stone
5,582,343 A 12/1996 Dalvey
5,584,430 A 12/1996 Mulry
5,588,585 A 12/1996 McClure
5,599,267 A 2/1997 Dupuy
5,601,521 A 2/1997 Plamas Xapelli
5,632,402 A 5/1997 Walsh et al.
5,639,017 A 6/1997 Fogle
5,678,755 A 10/1997 Block
5,699,957 A 12/1997 Blin et al.
5,706,947 A 1/1998 Hodges
5,709,766 A 1/1998 Press et al.
5,746,871 A 5/1998 Walsh
5,757,930 A 5/1998 Seidemann et al.
5,775,576 A 7/1998 Stone
5,783,030 A 7/1998 Walsh
5,794,778 A 8/1998 Harris
5,794,811 A 8/1998 Walsh
5,794,812 A 8/1998 Walsh
5,796,778 A 8/1998 Kurker
5,810,250 A 9/1998 Stone et al.
5,826,783 A 10/1998 Stout
5,842,576 A 12/1998 Snow
5,857,570 A 1/1999 Brown
5,857,614 A 1/1999 Walsh
5,873,515 A 2/1999 Dunn et al.
5,881,884 A 3/1999 Podosek
5,893,513 A 4/1999 Stone et al.
5,915,546 A 6/1999 Harrelson
5,918,799 A 7/1999 Walsh
5,921,398 A 7/1999 Carroll
5,927,498 A 7/1999 Saam
5,960,555 A 10/1999 Deaton et al.
5,967,374 A 10/1999 Baker
5,979,749 A 11/1999 Bozich
5,992,733 A 11/1999 Gomes
5,996,797 A 12/1999 Flaig
D419,440 S 1/2000 Hansen
6,015,084 A 1/2000 Mathieu et al.
6,021,897 A 2/2000 Sutherland
6,027,017 A 2/2000 Kuhn et al.
6,027,018 A 2/2000 Yocum
6,059,182 A 5/2000 Wein
6,065,590 A 5/2000 Spivey
6,092,716 A 7/2000 Smith
6,102,277 A 8/2000 Krapohl, Sr.
6,110,095 A 8/2000 Finke et al.
6,112,977 A 9/2000 Sutherland et al.
6,129,211 A 10/2000 Prakken et al.
6,131,729 A 10/2000 Eckermann et al.
6,135,289 A 10/2000 Miller
6,145,736 A 11/2000 Ours et al.
6,158,653 A 12/2000 Kanter et al.
6,164,526 A 12/2000 Dalvey
6,189,777 B1 2/2001 Hutchinson et al.
6,221,192 B1 4/2001 Walsh
6,227,367 B1 5/2001 Harrelson et al.
6,230,881 B1 5/2001 Collura
6,332,488 B1 12/2001 Walsh
6,352,096 B1 3/2002 Walsh
6,364,202 B1 4/2002 Zelley
6,386,639 B1 5/2002 McMichael
6,419,152 B1 7/2002 Tokarski
6,435,402 B1 8/2002 Hengami
6,478,159 B1 11/2002 Taylor et al.
6,510,982 B2 1/2003 White et al.
6,520,404 B1 2/2003 Waldburger et al.
6,523,692 B2 2/2003 Gregory
6,568,586 B1 5/2003 VanEsley et al.

(56) References Cited

U.S. PATENT DOCUMENTS

| | | | |
|---|---|---|---|
| 6,631,803 | B2 | 10/2003 | Rhodes et al. |
| 6,689,034 | B2 | 2/2004 | Walsh et al. |
| 6,729,475 | B2 | 5/2004 | Yuhas et al. |
| 6,761,269 | B2 | 7/2004 | Hamming |
| 6,834,793 | B2 | 12/2004 | Sutherland |
| 6,854,639 | B2 | 2/2005 | Walsh |
| 6,869,009 | B2 | 3/2005 | Sutherland et al. |
| 6,889,892 | B2 | 5/2005 | Walsh et al. |
| 6,905,027 | B2 | 6/2005 | Galter |
| 6,913,189 | B2 | 7/2005 | Oliff et al. |
| 6,918,487 | B2 | 7/2005 | Harrelson |
| 6,926,193 | B2 | 8/2005 | Smalley |
| 6,945,450 | B2 | 9/2005 | Rusnock |
| 6,948,293 | B1 | 9/2005 | Eckermann et al. |
| 6,997,316 | B2 | 2/2006 | Sutherland |
| 7,021,468 | B2 | 4/2006 | Cargile, Jr. |
| 7,025,504 | B2 | 4/2006 | Olin |
| 7,198,154 | B2 | 4/2007 | Tippey |
| 7,201,714 | B2 | 4/2007 | Zoeckler et al. |
| 7,380,701 | B2 | 6/2008 | Fogle et al. |
| 7,407,087 | B2 | 8/2008 | DeBusk et al. |
| 7,416,109 | B2 | 8/2008 | Sutherland |
| 7,601,111 | B2 | 10/2009 | Sutherland et al. |
| 7,611,042 | B2 | 11/2009 | Bates et al. |
| 7,658,318 | B2 | 2/2010 | Walsh et al. |
| 7,668,318 | B2 | 2/2010 | Goldfinch et al. |
| 7,699,215 | B2 | 4/2010 | Spivey, Sr. |
| 7,717,318 | B2 | 5/2010 | Brand |
| 7,717,322 | B2 | 5/2010 | Walsh et al. |
| 7,762,394 | B2 | 7/2010 | Bradford et al. |
| 7,900,816 | B2 | 3/2011 | Kastanek et al. |
| 8,220,701 | B2 | 7/2012 | Fontaine et al. |
| 8,556,160 | B2 | 10/2013 | Spivey, Sr. |
| 8,727,204 | B2 | 5/2014 | Burke |
| 8,814,033 | B2 | 8/2014 | House |
| 8,978,963 | B2 | 3/2015 | Kastanek et al. |
| 9,113,648 | B2 | 8/2015 | Burke |
| 9,376,240 | B1 | 6/2016 | McMurray et al. |
| 9,376,244 | B2 | 6/2016 | Kastanek et al. |
| 9,758,275 | B2 | 9/2017 | Fitzwater et al. |
| 9,771,176 | B2 | 9/2017 | Kastanek et al. |
| 2001/0048022 | A1 | 12/2001 | Zoeckler |
| 2002/0000463 | A1 | 1/2002 | Jaggi |
| 2002/0022560 | A1 | 2/2002 | Zoeckler et al. |
| 2002/0036153 | A1 | 3/2002 | Yang |
| 2002/0055429 | A1 | 5/2002 | Walsh |
| 2002/0060240 | A1 | 5/2002 | Walsh et al. |
| 2002/0170845 | A1 | 11/2002 | Oliff |
| 2003/0098344 | A1 | 5/2003 | Blake |
| 2003/0144121 | A1 | 7/2003 | Walsh et al. |
| 2003/0226879 | A1 | 12/2003 | Auclair et al. |
| 2004/0007614 | A1 | 1/2004 | Saulas |
| 2004/0112948 | A1 | 6/2004 | Bone |
| 2004/0226989 | A1 | 11/2004 | Cook et al. |
| 2005/0092649 | A1 | 5/2005 | Ford et al. |
| 2005/0103681 | A1 | 5/2005 | Aubry et al. |
| 2005/0109827 | A1 | 5/2005 | Martin |
| 2005/0133579 | A1 | 6/2005 | Smorch et al. |
| 2005/0167291 | A1 | 8/2005 | Sutherland |
| 2005/0187087 | A1 | 8/2005 | Walsh |
| 2005/0218203 | A1 | 10/2005 | Harrelson |
| 2006/0049067 | A1 | 3/2006 | McDonald |
| 2006/0096978 | A1 | 5/2006 | Lafferty et al. |
| 2006/0231600 | A1 | 10/2006 | Holley, Jr. |
| 2006/0231604 | A1 | 10/2006 | DeBusk et al. |
| 2006/0243783 | A1 | 11/2006 | Spivey et al. |
| 2006/0255105 | A1 | 11/2006 | Sweet |
| 2006/0255107 | A1 | 11/2006 | Wright |
| 2006/0266815 | A1 | 11/2006 | Coltri-Johnson et al. |
| 2006/0268810 | A1 | 11/2006 | Cheng |
| 2006/0273143 | A1 | 12/2006 | Finch |
| 2007/0000984 | A1 | 1/2007 | McClure |
| 2007/0051781 | A1 | 3/2007 | Holley |
| 2007/0080199 | A1 | 4/2007 | Sutherland |
| 2007/0131749 | A1 | 6/2007 | Coltri-Johnson et al. |
| 2007/0164091 | A1 | 7/2007 | Fogle et al. |
| 2007/0181658 | A1 | 8/2007 | Sutherland |
| 2007/0241102 | A1 | 10/2007 | Carmichael et al. |
| 2007/0284424 | A1 | 12/2007 | Holley |
| 2008/0290149 | A1 | 11/2008 | Sweet |
| 2010/0140335 | A1 | 6/2010 | Brand |
| 2010/0183773 | A1 | 7/2010 | Malone et al. |
| 2011/0011924 | A1 | 1/2011 | Spivey, Sr. et al. |
| 2011/0117258 | A1 | 5/2011 | Burke |
| 2011/0253776 | A1 | 10/2011 | Craft et al. |
| 2011/0309134 | A1 | 12/2011 | Weissbrod |
| 2012/0085769 | A1 | 4/2012 | Millet |
| 2012/0145774 | A1 | 6/2012 | Spivey, Sr. |
| 2013/0142921 | A1* | 6/2013 | Fitzwater ..... A47G 21/001 426/135 |
| 2014/0234505 | A1 | 8/2014 | Burke |

FOREIGN PATENT DOCUMENTS

| | | | |
|---|---|---|---|
| CA | 2 918 510 | 4/2015 | |
| CA | 2918510 | 4/2015 | |
| CH | 692 649 | 9/2002 | |
| DE | 1 091 851 | 10/1960 | |
| DE | 2 320 190 | 4/1973 | |
| DE | 29 23 455 | 9/1979 | |
| DE | 81 10 323.9 | 4/1981 | |
| DE | 87 08 078.8 | 9/1987 | |
| DE | 3 627 019 | 2/1988 | |
| DE | 89 08 393 | 9/1989 | |
| DE | 94 13 813 | 8/1994 | |
| DE | 297 03 082 | 6/1998 | |
| DE | 298 17 195 | 9/1998 | |
| DE | 202 16 854 | 2/2002 | |
| DE | 20 2004 018 649 | 4/2005 | |
| DE | 102005005500 | 3/2006 | |
| DE | 102005053561 | 5/2007 | |
| EP | 0 079 155 | 5/1983 | |
| EP | 0 133 595 | 2/1985 | |
| EP | 0 412 226 | 2/1991 | |
| EP | 0 542 449 | 5/1993 | |
| EP | 0 704 386 | 4/1996 | |
| EP | 1 457 425 | 9/2004 | |
| FR | 1 379 931 | 12/1963 | |
| FR | 1 494 239 | 9/1967 | |
| FR | 2 579 175 | 9/1986 | |
| FR | 2 699 150 | 12/1992 | |
| FR | 2 686 316 | 7/1993 | |
| FR | 2 755 670 | 5/1998 | |
| FR | 2 882 032 | 8/2006 | |
| GB | 104445 | 6/1916 | |
| GB | 1 218 016 | 1/1971 | |
| GB | 1 242 356 | 8/1971 | |
| GB | 1 489 963 | 10/1977 | |
| GB | 1 584 066 | 2/1981 | |
| GB | 2 137 172 | 10/1984 | |
| GB | 2 275 913 | 9/1994 | |
| GB | 2 361 000 | 10/2001 | |
| GB | 2 363 372 | 12/2001 | |
| GB | 2 379 923 | 3/2003 | |
| JP | 44-25911 | 10/1969 | |
| JP | 57-123729 | 8/1982 | |
| JP | 59-181025 | 12/1984 | |
| JP | 07291367 A * | 11/1995 | ..... B65D 33/06 |
| JP | 08-198349 | 8/1996 | |
| JP | 2001-192016 | 7/2001 | |
| JP | 2004-018010 | 1/2004 | |
| JP | 2004-042953 | 2/2004 | |
| JP | 2007 022611 A | 2/2007 | |
| JP | 2008-545596 | 12/2008 | |
| JP | 53-39118 | 3/2010 | |
| KR | 20-1998-056170 | 10/1998 | |
| WO | WO 92/01606 | 2/1992 | |
| WO | WO 95/28325 | 10/1995 | |
| WO | WO 97/27114 | 7/1997 | |
| WO | WO 98/31593 | 7/1998 | |
| WO | WO 02/11516 | 2/2002 | |
| WO | WO 03/051622 | 6/2003 | |
| WO | WO 03/082686 | 9/2003 | |
| WO | WO 2004/063031 | 7/2004 | |

(56) References Cited

FOREIGN PATENT DOCUMENTS

| | | |
|---|---|---|
| WO | WO 2006/133401 | 12/2006 |
| WO | WO 2007/007197 | 1/2007 |
| WO | WO 2007/089282 | 8/2007 |
| WO | WO 2007/146804 A1 | 12/2007 |
| WO | WO 2015/179651 A2 | 11/2015 |

OTHER PUBLICATIONS

Office Action for Canadian Application No. 3,038,134 dated Mar. 6, 2020.

Supplementary Partial European Search Report for Ep 17 86 9694.4 dated Apr. 28, 2020.

* cited by examiner

RECONFIGURABLE CARTON AND PACKAGE

CROSS-REFERENCE TO RELATED APPLICATION

This application claims the benefit of U.S. Provisional Patent Application No. 62/421,575, filed on Nov. 14, 2016.

INCORPORATION BY REFERENCE

The disclosure of U.S. Provisional Patent Application No. 62/421,575, filed on Nov. 14, 2016, is hereby incorporated by reference for all purposes as if presented herein in its entirety.

BACKGROUND OF THE DISCLOSURE

The present disclosure generally relates to cartons or packages that expand. In one embodiment, the present disclosure relates to cartons or packages that include a flexible liner for holding and heating products and which expand and that include a substantially rigid portion for holding the flexible liner.

SUMMARY OF THE DISCLOSURE

According to one aspect of the disclosure, a carton for holding a product in a liner is disclosed, the carton comprising a plurality of panels extending at least partially around an interior of the carton, the plurality of panels comprising a front panel, at least one rear panel, and at least one side panel. At least one end flap is foldably connected to a respective panel of the plurality of panels. The at least one side panel comprises at least one expansion feature configured to transition the carton between a first configuration and a second configuration, the at least one expansion feature is foldably connected to the front panel and the at least one rear panel.

According to another aspect of the disclosure, a blank for forming a carton for holding a product in a liner is disclosed, the blank comprising a plurality of panels for extending at least partially around the carton formed from the blank, the plurality of panels comprising a front panel, at least one rear panel, and at least one side panel. At least one end flap is foldably connected to a respective panel of the plurality of panels. The at least one side panel comprises at least one expansion feature configured to transition the carton between a first configuration and a second configuration when the carton is formed from the blank, the at least one expansion feature is foldably connected to the front panel and the at least one rear panel.

According to another aspect of the disclosure, a method of forming a carton for holding a product in a liner is disclosed, the method comprising providing a blank, the blank comprising a plurality of panels comprising a front panel, at least one rear panel, and at least one side panel. The at least one side panel comprises at least one expansion feature foldably connected to the front panel and the at least one rear panel, and the blank further comprises at least one end flap foldably connected to a respective panel of the plurality of panels. The method further comprises folding the plurality of panels at least partially around an interior of the carton such that the carton is provided in one of a first configuration and a second configuration. The at least one expansion feature is configured to transition the carton between the first configuration and the second configuration.

Those skilled in the art will appreciate the above stated advantages and other advantages and benefits of various additional embodiments reading the following detailed description of the embodiments with reference to the below-listed drawing figures.

According to common practice, the various features of the drawings discussed below are not necessarily drawn to scale. Dimensions of various features and elements in the drawings may be expanded or reduced to more clearly illustrate the embodiments of the disclosure.

BRIEF DESCRIPTION OF THE DRAWINGS

Corresponding parts are designated by corresponding reference numbers throughout the drawings.

DETAILED DESCRIPTION OF THE EXEMPLARY EMBODIMENTS

The package or carton of the present disclosure can be useful in containing a product such as any suitable type of food product that can be heated, for example, cooked, browned, crisped, etc. Such heating can occur, for example, in a microwave oven. The food product can include frozen food products or nonfrozen food products, and can include food products that are to be subjected to heating, for example, popcorn. It is understood that food products other than the food products listed herein may be contained in the package or carton. Further, food products contained in the package or carton may be generally triangular, round, square, rectangular, irregular, or any other shape.

In this specification, the terms "lower," "bottom," "upper" and "top" indicate orientations determined in relation to fully erected and upright packages or cartons. Further, as described herein, packages or cartons may be formed from blanks by overlapping multiple panels and/or end flaps. Such panels and/or end flaps may be designated herein in terms relative to one another, e.g., "first", "second", "third", etc., in sequential or non-sequential reference, without departing from the disclosure.

Figure 1:
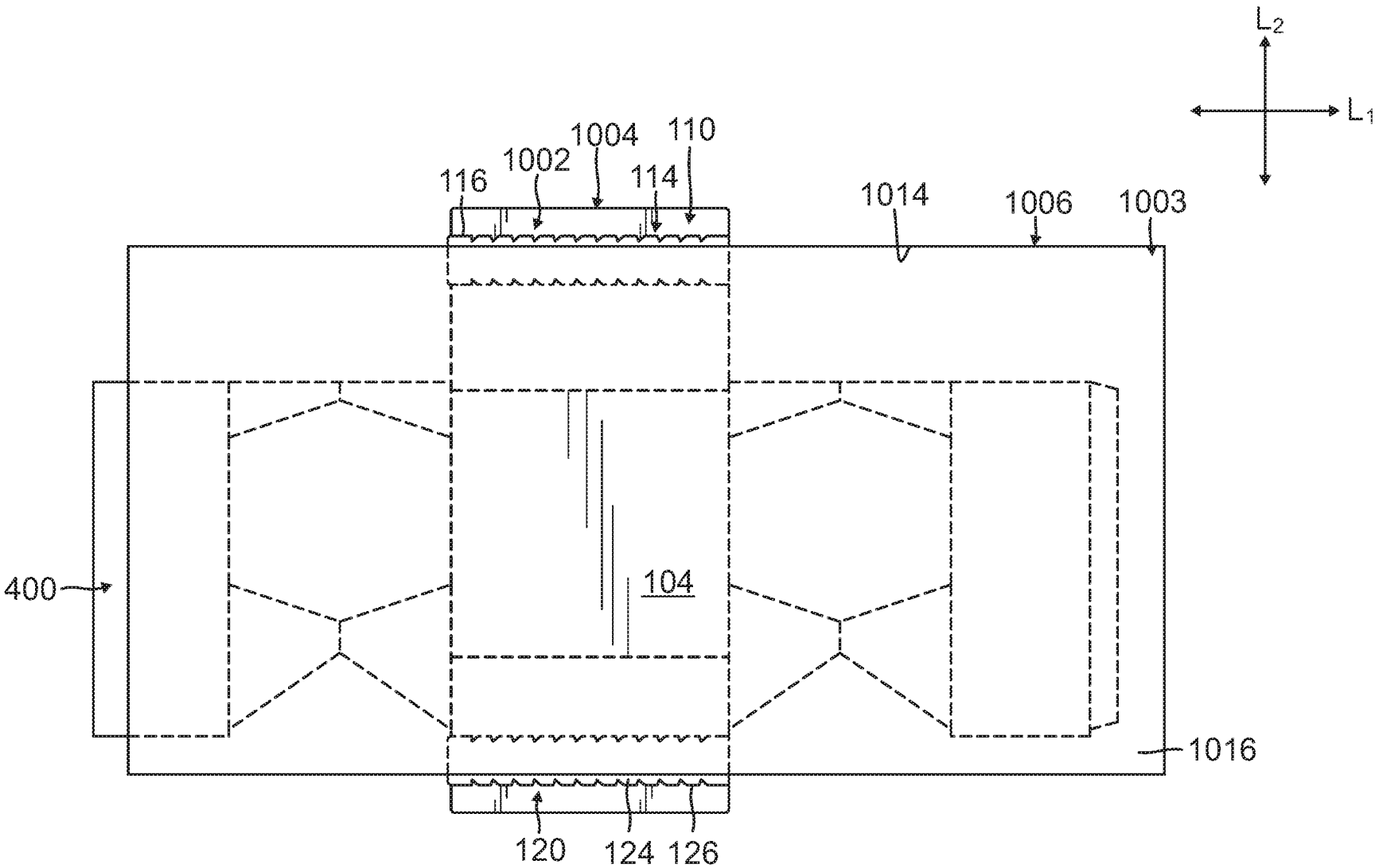
FIG. 1 is a plan view of an interior side of a blank and liner for forming a package or a carton according to a first exemplary embodiment of the disclosure.

FIG. 1 is a plan view of an of an interior side 1002 of a blank, generally indicated at 1004, and an interior side 1003 of a liner, generally indicated at 1006, used to form a carton 1000 (FIG. 5) that is expandable. A package 1008 (FIG. 8) can comprise the carton 1000 according to the present disclosure. The carton 1000 and/or the package 1008 can be for holding, storing, heating, and/or cooking a food product F (FIG. 8) according to a first exemplary embodiment of the disclosure. The carton 1000 and/or the package 1008 can be used to hold other nonfood products or items without departing from the disclosure. The expanded carton 1000 provides an at least semi-rigid or at least partially rigid support structure 1028 (FIG. 8) for supporting a pouch 1010 (FIG. 7) formed from the liner 1006. As described herein, semi-rigid or at least partially rigid refers to a property of the expanded carton 1000 or package 1008 relative to the liner 1006, in which portions of the carton 1000 or the package 1008 formed from the blank 1004, while at least partially moveable, have a higher degree of resistance to movement than the liner 1006.

In the illustrated embodiment, the carton 1000 and/or the package 1008 can be suitable for holding any number of products including a single food product or more than two food products. Further, the carton 1000 and/or the package 1008 can be alternatively sized, shaped and/or otherwise arranged to hold food products or nonfood products. In one embodiment, the carton 1000 and/or the package 1008 may be useful for holding food products during storage in a freezer, during heating and/or cooking, and/or during serving or consumption of heated and/or cooked food products. In one embodiment, the carton 1000 and/or the package 1008 holds the uncooked food product F in a first, unexpanded configuration of the pouch 1010 (FIG. 5) and is configured to support the pouch 1010 upon expansion of the carton 1000 and/or the package 1008 into a second, expanded configuration of the pouch 1010 upon heating.

Figure 2:
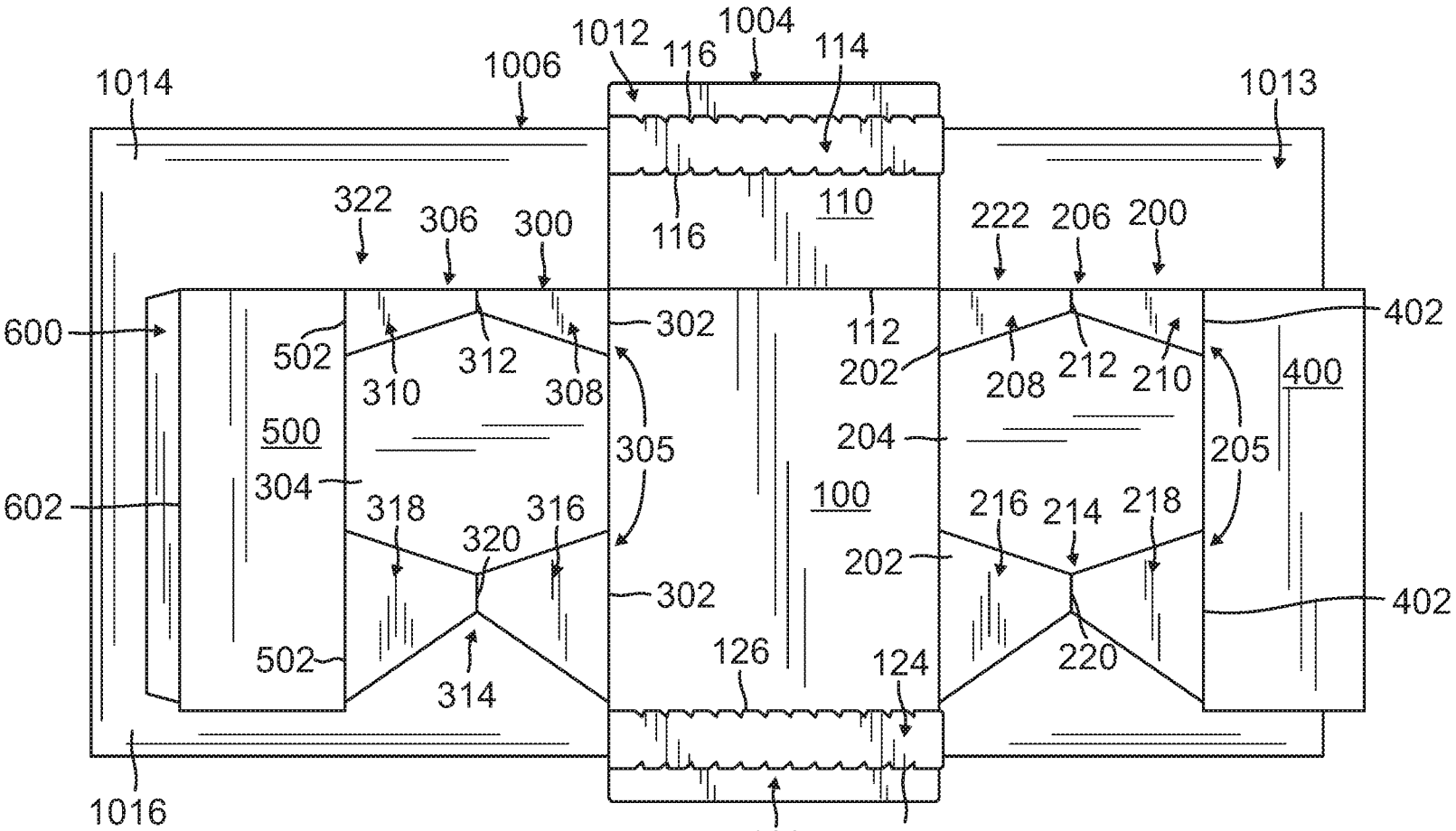
FIG. 2 is a plan view of an exterior side of the blank and liner of FIG. 1 according to the first exemplary embodiment of the disclosure.

As shown in FIG. 1, and referring additionally to an exterior side 1012 of the blank 1004 and an exterior side 1013 of the liner 1006 in FIG. 2, the blank 1004 has a longitudinal axis L1 and a lateral axis L2. In the illustrated embodiment, the blank 1004 includes a plurality of panels that are for extending around an interior 1011 (FIG. 3) of the carton 1000 or the package 1008 and which includes a front panel 100 foldably connected to a first side panel 200 at a first lateral fold line 202, a second side panel 300 is foldably connected to the front panel 100 at a second lateral fold line 302, a first rear panel 400 is foldably connected to the first side panel 200 at a third lateral fold line 402, and a second rear panel 500 is foldably connected to the second side panel 300 at a fourth lateral fold line 502. As also shown, an attachment flap 600 is foldably attached to the second rear panel 500 at a lateral fold line 602. The attachment flap 600 facilitates formation of the carton 1000 (FIG. 5) from the blank 1004, as described further herein. The blank 1004 can be otherwise configured to have any number of side panels and/or adhesive flaps without departing from the scope of this disclosure.

In the illustrated embodiment, a top end flap 110 and a bottom end flap 120 are each foldably connected to the front panel 100. The top end flap 110 is foldably connected to the front panel 100 at a longitudinal fold line 112 and includes an opening feature or tear strip 114 defined at longitudinal tear lines 116. The bottom end flap 120 is connected to the front panel 100 and includes an opening feature or tear strip 124 defined along longitudinal tear lines 126 such that the tear strips 114, 124 are selectively removable from the remainder of the end flaps 110, 120. In one embodiment, the bottom end flap 120 can be foldably connected to the front panel 100 at a fold line. One or both of the tear strips 114, 124 can include features to facilitate removal from the remainder of the respective top end flap 110 and bottom end flap 120, for example, notches, cuts, corrugations, and/or other surface features. In one embodiment, the top end flap 110 and/or the bottom end flap 120 may be devoid of longitudinal fold lines or a tear line may serve as both a fold line and a tear line. As shown, the top end flap 110 may have a greater length along lateral axis L2 than the bottom end flap 120, for example, the top end flap 110 can have a length of about 3.125 inches along the lateral axis L2 and the bottom flap 120 can have a length of about 1.375 inches along the lateral axis L2. In one embodiment, the top end flap 110 and the bottom end flap 120 may have similar lengths along lateral axis L2, or may have other relative lengths than shown (for example, the bottom end flap 120 may have a greater length than top end flap 110). In one embodiment, an adhesive flap may be foldably connected to one or both of the top end flap 110 and the bottom end flap 120.

In the illustrated embodiment, the first side panel 200 includes an aperture 204 formed therealong between an upper portion 206 and a lower portion 214 of the first side panel 200. The aperture 204 may have a generally hexagonal configuration, as shown, or may have a differently-shaped configuration. The aperture 204 may be formed by removing a portion of blank 1004, for example, a tear-away or strip-out portion. In other embodiments, the blank 1004 may be formed to define the aperture 204 without removal of any portions of the blank 1004.

In the illustrated embodiment, the first side panel 200 also includes expansion features 205 that include the upper portion 206 with a front section 208 foldably connected to the front panel 100 at the fold line 202 and a rear section 210 foldably connected to the rear panel 400 at the fold line 402. The front section 208 and the rear section 210 are foldably connected at a lateral fold line 212. The expansion features 205 of the first side panel 200 also include the lower portion 214 having a front section 216 foldably connected to the front panel 100 at the fold line 202 and a rear section 218 foldably connected to the rear panel 400 at the fold line 402. The front section 216 and the rear section 218 are foldably connected at a lateral fold line 220. As shown, the aperture 204 is disposed between the front section 208 and the front section 216 and the aperture 204 is disposed between the front section 216 and the rear section 210. The upper portion 206 and the lower portion 214 of the first side panel 200 may each have a bowtie-shaped configuration, e.g., respective first and second substantially trapezoidal sections 208, 216 and 210, 218 meeting at respective fold lines 212 and 220. Alternatively, the upper portion 206 and the lower portion 210 may have a different configuration without departing from the disclosure. As shown in FIG. 1, the lower portion 214 of first side panel 200 may be differently-sized, e.g., larger, than the upper portion 206 of the first side panel 200. In one embodiment, the upper portion 206 and the lower portion 214 may be similarly-sized, or may have different relative sizes than shown, e.g., upper portion 206 may be larger than lower portion 214 without departing from the disclosure.

The second side panel 300, as shown, is shaped similarly to the first side panel 200, with like components similarly designated. As shown, the second side panel 300 includes an aperture 304 and expansion features 305 that include an upper portion 306 with a front section 308 foldably connected to the front panel 100 at the fold line 302 and a rear section 310 foldably connected to the rear panel 500 at the fold line 502. The front section 308 and the rear section 310 are foldably connected at a lateral fold line 312. A lower portion 314 of the second side panel 300 includes a front section 316 foldably connected to the front panel 100 at the fold line 302 and a rear section 318 foldably connected to the rear panel 500 at the fold line 502. The front section 316 is foldably connected to the rear section 318 at a lateral fold line 320.

Figure 7:
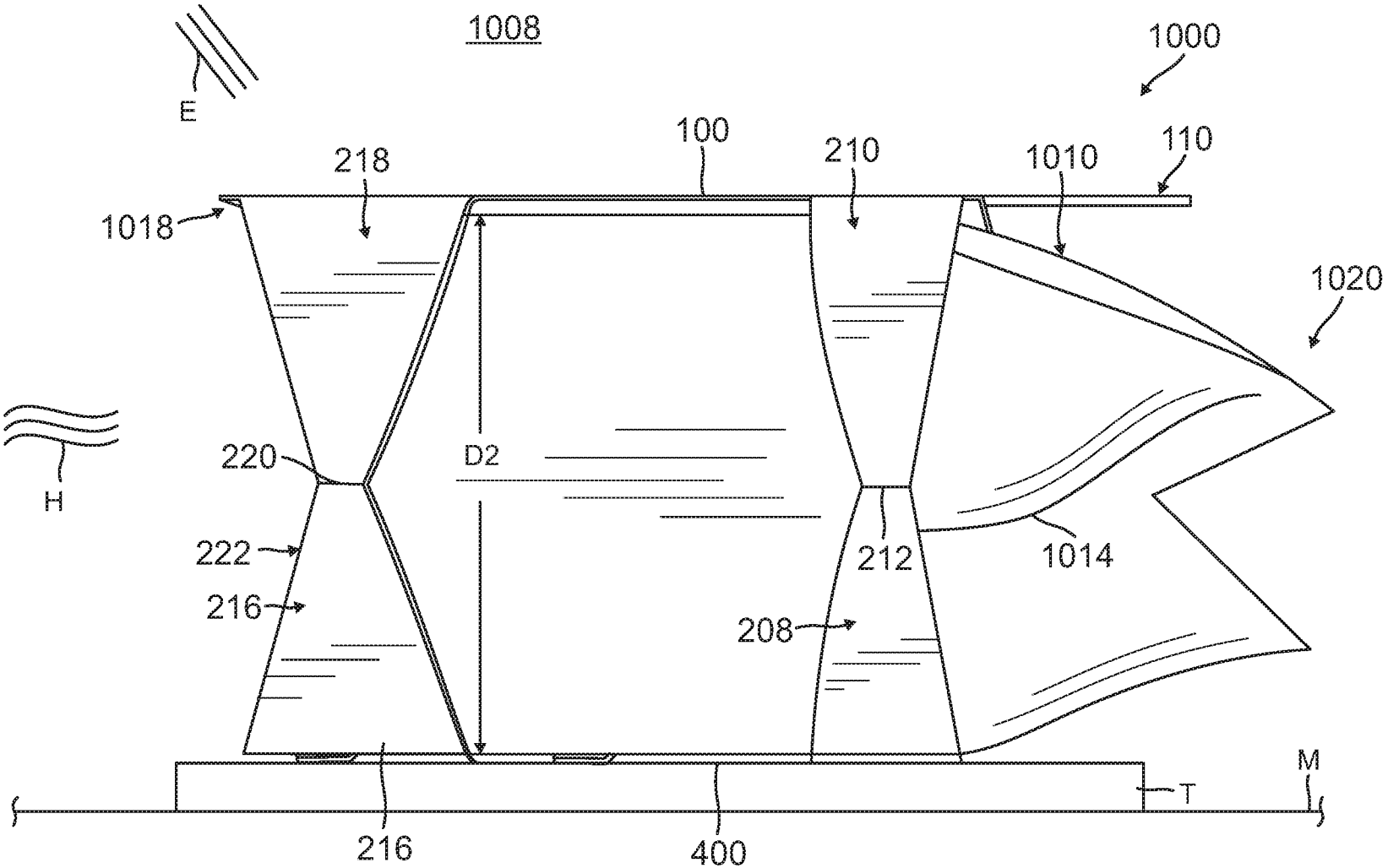
FIG. 7 is a perspective view of the package or carton of FIG. 6 being subject to heating and transitioning from the first or unexpanded configuration to a second or expanded configuration.

In this regard, the upper portion 206 and the lower portion 214 of the first side panel 200 provides a jointed connection between the first rear panel 400 and the front panel 100 due to the presence of the fold lines 212 and 220 to define a first expansion region 222 of the carton 1000 (FIG. 5) that is foldably connected to the first rear panel 400 at the fold line 402 and that is foldably connected to the front panel 100 at the fold line 202. Similarly, the upper portion 306 and the lower portion 314 of the second side panel 400 provides a jointed connection between the second rear panel 500 and the front panel 100 due to the presence of the fold lines 312 and 314 to define a second expansion region 322 of the carton 1000 (FIG. 5) that is foldably connected to the front panel 100 at the fold line 302 and that is foldably connected to the second rear panel 500 at the fold line 502. As described herein, the expansion features 205, 305 along the respective expansion regions 222, 322 are configured to facilitate transition between the first, unexpanded configuration of the carton 1000 (FIG. 5) and the second, expanded configuration of the carton 1000 (FIG. 7).

Figure 3:
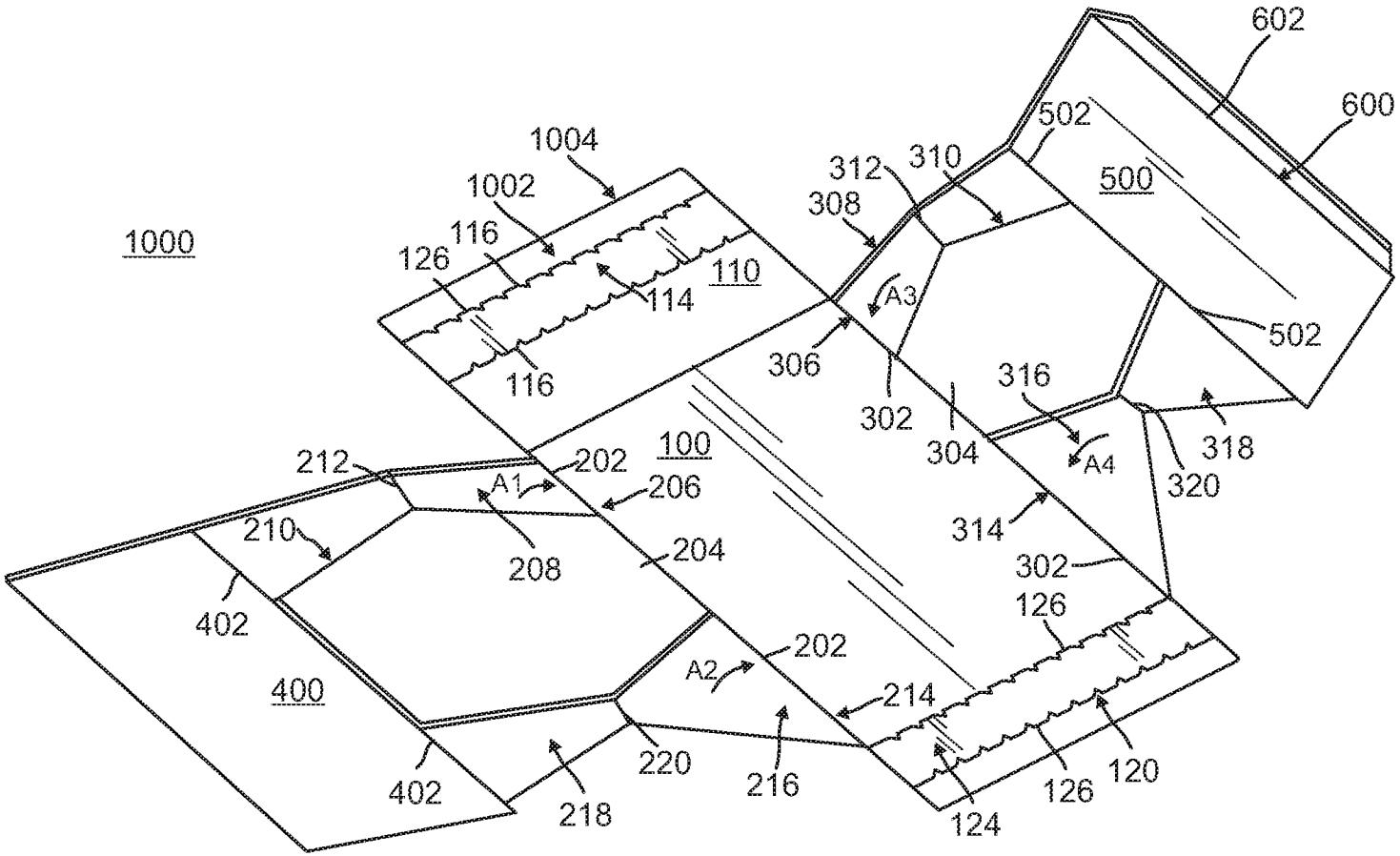
FIG. 3 is a first sequential perspective schematic view of a partially-folded configuration of the blank of FIG. 1 according to the first exemplary embodiment of the disclosure.
Figure 8:
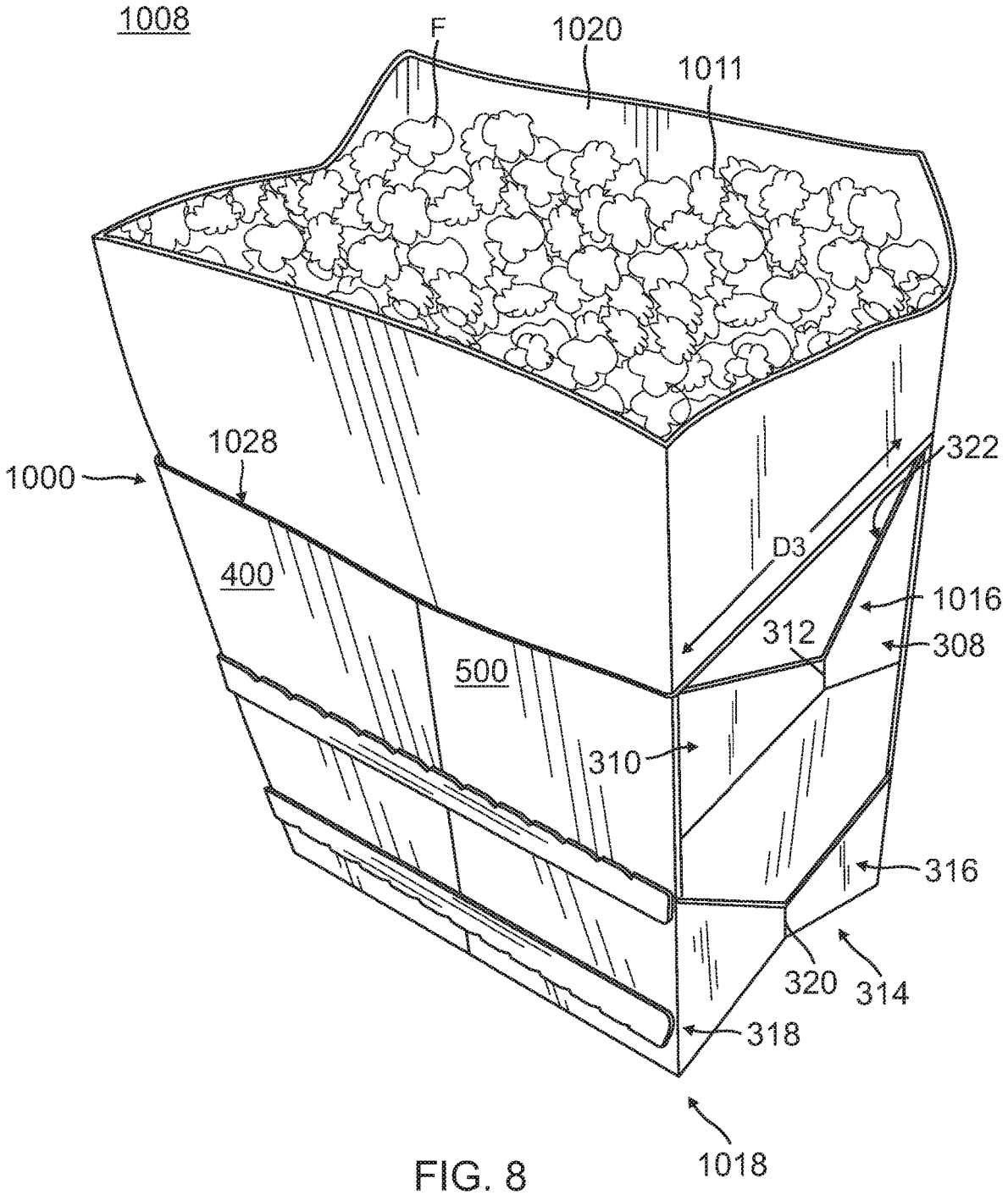
FIG. 8 is a perspective view of the package or carton of FIG. 5 in the second or expanded configuration according to the first exemplary embodiment of the disclosure.

Still referring to FIGS. 1 and 2, and referring additionally to FIG. 3, the liner 1006 may be a film or other flexible material that is adhesively secured to at least a portion of one or more of the front panel 100, the first side panel 200, the second side panel 300, the first rear panel 400, and the second rear panel 500 on the interior side 1002 of the blank 1004. In one embodiment, the liner 1006 may be adhesively secured to less than all of the panels 100, 200, 300, 400, and 500, and/or may be adhesively secured to one or more portions of the end flaps 110, 120. The liner 1006 may overlap the blank 1004 to provide portions that are free from attachment to the blank 1004 so that the liner 1006 is at least partially expandable and/or reconfigurable independently of the blank 1002. In this regard, the liner 1006 may have free portions 1014 adjacent or above a marginal area of the blank 1004 near the top end flap 110 and free portions 1016 adjacent or below a marginal area of the blank 1004 near the bottom end flap 120. The liner 1006 may be formed from one or more of polymeric or non-polymeric materials. In one embodiment, the liner 1006 may be formed from a material that is at least partially transparent, or may be at least partially opaque. In one embodiment, the liner 1006 could have venting apertures that allow venting of hot air or steam from the interior 1011 (FIG. 3) of the carton 1000 (FIG. 5) or the package 1008 (FIG. 8). While the illustrated embodiment show the liner 1006 secured to portions of the blank 1002, the blank 1002 can be provided without a liner or can have a liner subsequently secured thereto.

Still referring to FIGS. 1 and 2, the liner 1006 may include a microwave energy interactive material in the form of a susceptor 104 that can promote heating, browning, and/or crisping of a particular area of a food item. The susceptor 104 may be positioned, e.g., embedded, layered, adhered, or otherwise disposed on the liner 1006 to align with the front panel 100, or, in one embodiment, may be positioned along additional or alternative regions of the liner 1006. The susceptor 104 may include an electroconductive or semiconductive material, for example, a vacuum deposited metal or metal alloy, or a metallic ink, an organic ink, an inorganic ink, a metallic paste, an organic paste, an inorganic paste, or any combination thereof. Examples of metals and metal alloys that may be suitable include, but are not limited to, aluminum, chromium, copper, inconel alloys (nickel-chromium-molybdenum alloy with niobium), iron, magnesium, nickel, stainless steel, tin, titanium, tungsten, and any combination or alloy thereof. In one embodiment, the susceptor 104 may be formed from one or more of a metal oxide, a dielectric, a ferroelectric, and/or may be carbon-based. In one embodiment, the liner 1006 may incorporate one or more additional or alternative microwave energy interactive material, for example, to shield a particular area of a food item from microwave energy and/or to transmit microwave energy toward or away from a particular area of a food item. In one embodiment, the carton 1000 (FIG. 5) can be devoid of a susceptor and/or other microwave energy interactive material.

Figure 4:
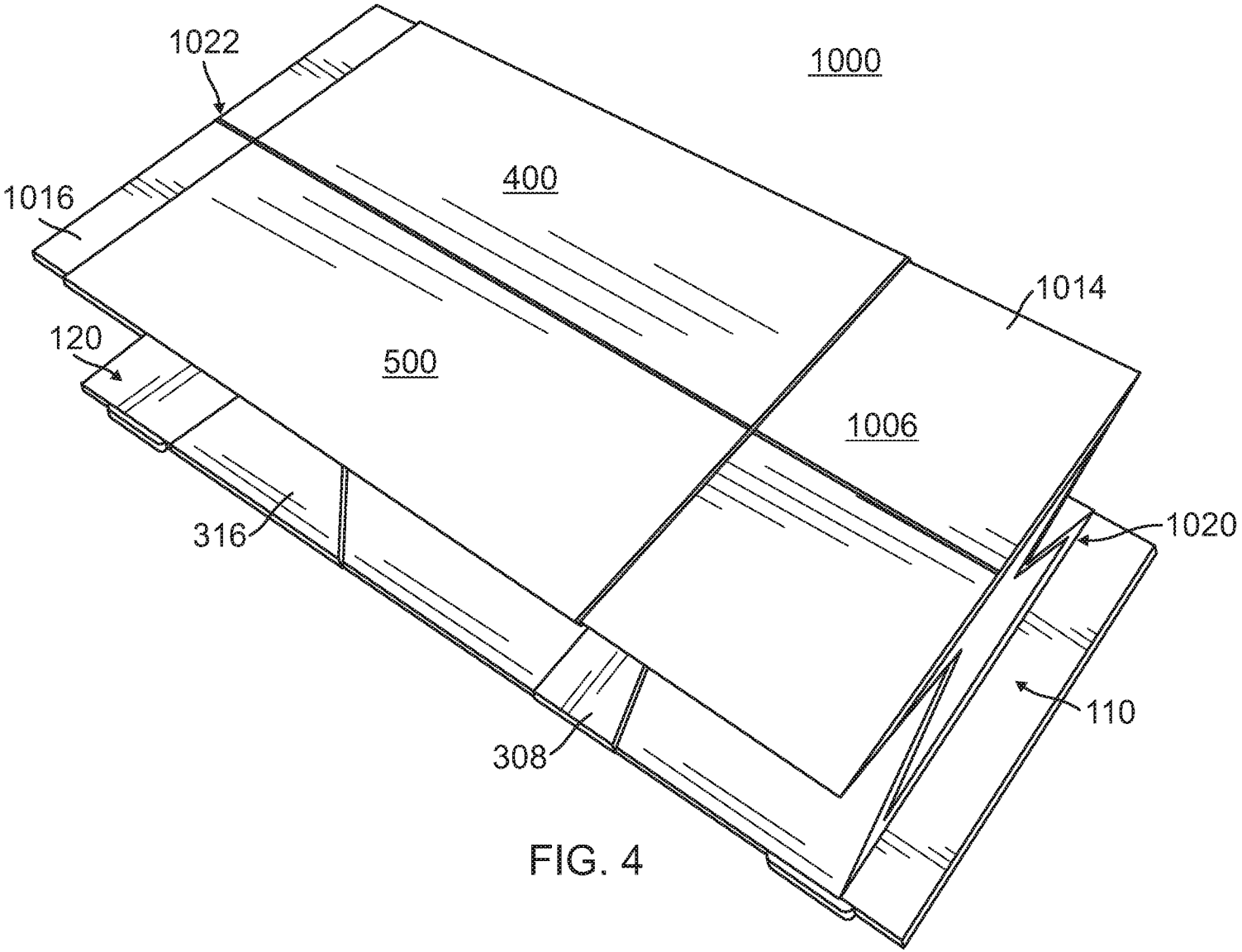
FIG. 4 is a third sequential perspective schematic view of a partially-folded configuration of the blank and liner of FIG. 1 according to the first exemplary embodiment of the disclosure.

Still referring to FIGS. 1 and 2, and referring additionally to FIGS. 3 and 4, the blank 1004 is shown in a partially-assembled configuration of the carton 1000 with the liner 1006 at least partially folded therein. In the illustrated configuration, the front section 208 of the upper portion 206 and the front section 216 of the lower portion 214 of the first side panel 200 can be folded inwardly (e.g., interiorly) at the fold line 202 over the front panel 100 to be positioned in the direction of the arrows A1 and A2, and the front section 308 of the upper portion 306 and the front section 316 of the lower portion 314 of the second side panel 300 can be folded inwardly at the fold line 302 over the front panel 100 to be positioned in the direction of the arrows A3 and A4.

Figure 3A:
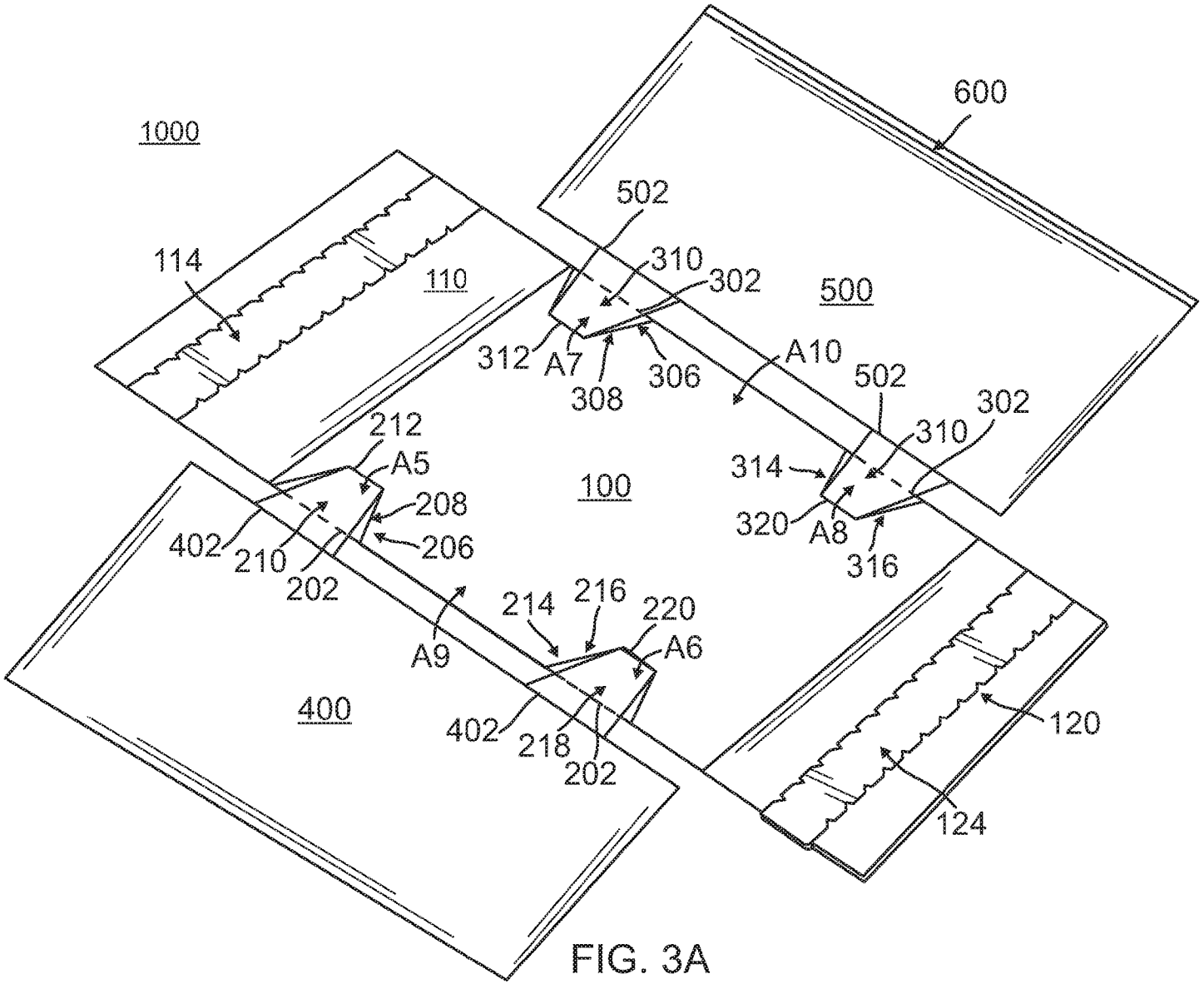
FIG. 3A is a second sequential perspective schematic view of a partially-folded configuration of the blank of FIG. 1 according to the first exemplary embodiment of the disclosure.

Referring additionally to FIG. 3A, the rear section 210 of the upper portion 206 and the rear section 218 of the lower portion 214 of first side panel 200 can be folded outwardly (e.g., exteriorly) at respective fold lines 212 and 220 relative to the respective front sections 208 and 216 to be positioned in at least partial overlapping and/or face-to-face contact with the respective front sections 208 and 216 in the direction of the arrows A5 and A6, and the rear section 310 of the upper portion 314 and the rear section 318 of the lower portion 314 of the second side panel 300 can be folded outwardly at respective fold lines 312 and 320 relative to the respective front sections 308 and 316 to be positioned in at least partial overlapping and/or face-to-face contact with the respective front sections 308 and 316 in the direction of the arrows A7 and A8. Thereafter, the first rear panel 400 and the second rear panel 500 can be folded inwardly at the fold lines 402, 502 into overlapping relation in the direction of the arrows A9 and A10. The first rear panel 400 and the second rear panel 500 can be secured to one another, for example, via at least partial face-to-face contact of the adhesive flap 600 and the first rear panel 400.

It will be understood that food product F may be placed upon the liner 1006 and/or the susceptor 104 prior to the aforementioned folding steps so as to be enclosed therein. In one embodiment, the food product F may be placed within the carton 1000 during a different step. Thereafter, the free portions 1014 and 1016 of the liner 1006 may be sealed, e.g., heat sealed or adhered, together such that the liner 1006 is configured with closed ends 1020, 1022 to form the pouch 1010. Alternatively, one of the free portions 1014, 1016 can be closed and sealed to form a bag and the food product F can be placed into the bag prior to the closing and sealing of the other of the free portions 1014, 1016 without departing from the scope of the disclosure.

Figure 5:
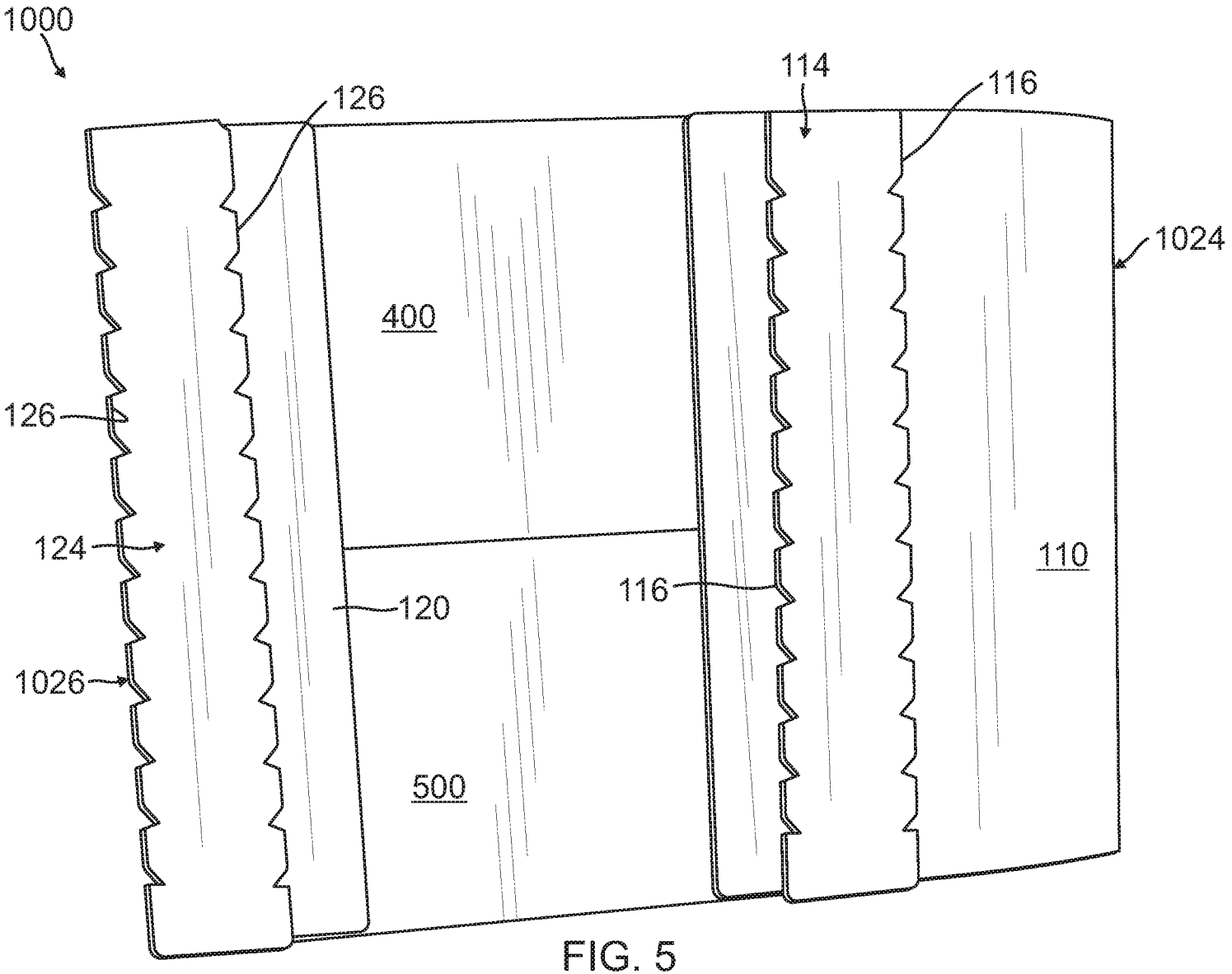
FIG. 5 is a perspective view of a package or carton formed from the carton blank and the liner of FIG. 1 and in a first or unexpanded configuration.

Still referring to FIGS. 1-4, and referring additionally to FIG. 5, the top end flap 110 and the bottom end flap 120 may be folded inwardly and into overlapping relation and at least partial face-to-face contact with the first and second rear panels 400, 500 to form the carton 1000 in the first, unexpanded configuration. The top end flap 110 and the bottom end flap 120 may be secured to one or both of the first and second rear panels 400, 500, for example, with an adhesive or an adhesive flap such that ends 1024, 1026 of the carton 1000 are provided in a closed configuration. In this regard, the top end flap 110 and the bottom end flap 120 partially enclose and overlie the front panel 100 and the first and second rear panels 400, 500 such that the front panel 100 is secured to the first and second rear panels 400, 500 and the closed ends 1024, 1026 are provided. In the first, unexpanded configuration, the carton 1000 is in a flat configuration with the front sections 208, 216, 308, 316 of the side panels 200, 300 folded to be in face-to-face contact with respective rear portions 210, 218, 310, 318 of the respective side panels 200, 300. As also shown, in the first, unexpanded configuration, the overlapped back panels 400, 500 are brought into close proximity with the front panel 100 with the food product F (FIG. 8) being stored in the pouch 1010 between the front panel 100 and the overlapped back panels 400, 500. In some embodiments, the carton 1000 in the first, unexpanded configuration will be the configuration of the carton 1000 that is presented for display and/or purchase by a consumer or that is packaged with multiple packages for shipment to a retail or other point-of-sale location.

Figure 6:
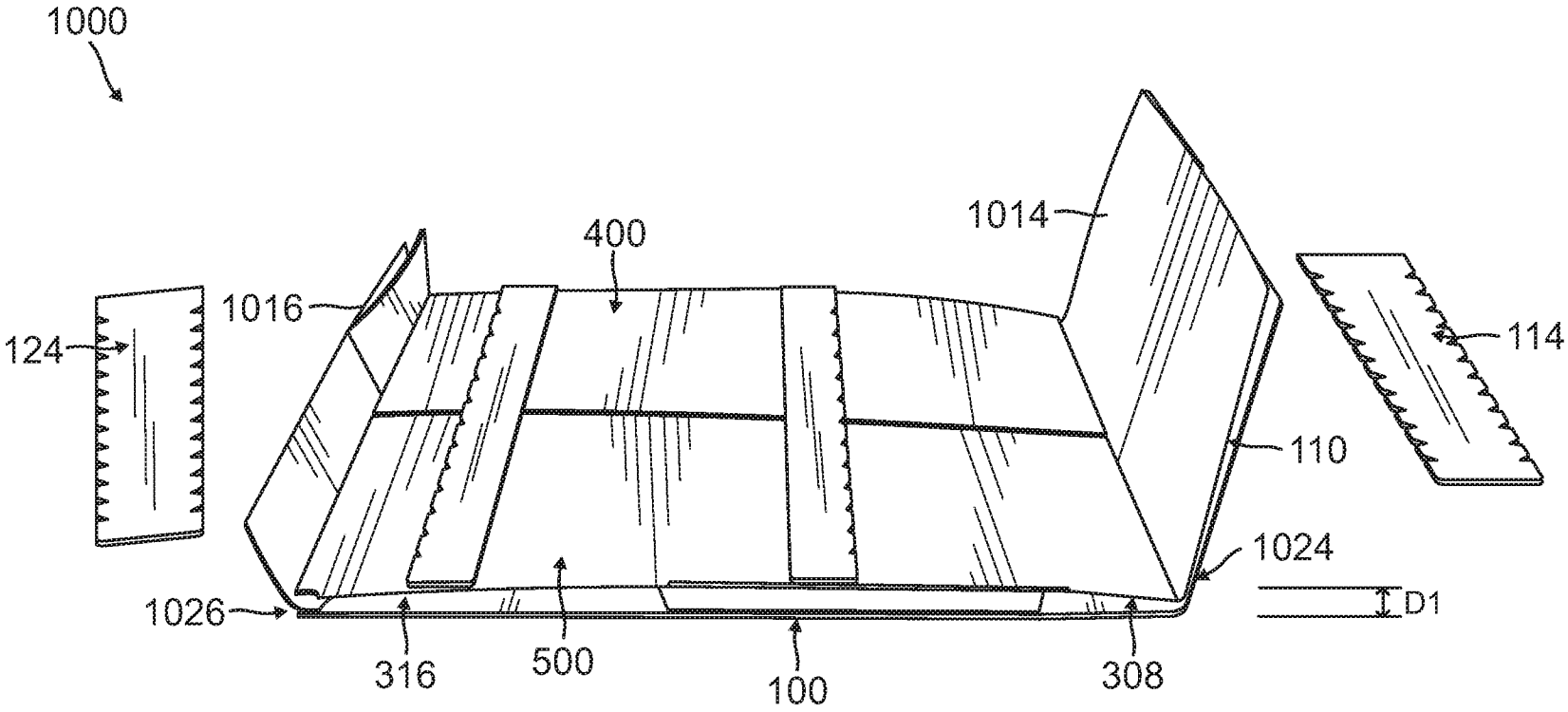
FIG. 6 is a perspective view of the package or carton of FIG. 5 having opening features removed.

Still referring to FIGS. 1 and 2, and referring additionally to FIG. 6, the tear strips 114, 124 are shown having been removed from the carton 1000 such that the ends 1024, 1026 of the carton 1000 have an open configuration. The tear strips 114, 124 can be manually removed by a user along respective tear lines 116, 126 to separate the end flaps 110, 120 from the overlapped back panels 400, 500 so that the ends 1024, 1026 are provided in an unsecured or open configuration. As a result of the removal of the tear strips 114, 124, the front panel 100 is unsecured from the first and second rear panels 400, 500 such that the front panel 100 is positionable relative to the back panels 400, 500 so that a second, expanded configuration of the carton 1000 can be formed upon the application of heat to the carton 1000, as described further herein.

Still referring to FIG. 1, and turning additionally to FIGS. 7 and 8, the carton 1000 is shown on the turntable T of a microwave oven M in transition toward the second, expanded configuration as it is subjected to heat H. Heat H may be provided by microwave energy E supplied by the microwave oven M. In alternative embodiments, the carton 1000 can be subjected to heat from a different source, for example, a conventional oven, stovetop, and/or open flame, to name a few. In this regard, at least a portion of the microwave energy E may be converted to conductive heat by the susceptor 104 of the carton 1000. The second, expanded configuration of the carton 1000 may be achieved, for example, by heating the food product F within the interior 1011 of the carton 1000 causing expansion of the food product F and/or air in the pouch 1010 such that the pouch 1010 expands against the panels 100, 200, 300, 400, 500 to cause relative unfolding thereof specifically, the expansion regions 222, 322 unfold via relative movement of the sections 208, 210, 216, 218, 308, 310, 316, 318 such that the front panel 100 and the first and second rear panels 400, 500 move away from one another. As shown, the front panel 100 moves from a spacing from the first and second rear panels 400, 500 of a first distance D1 (FIG. 6) to a second, greater distance D2 to define the carton 1000 in the second, expanded configuration. As shown, in the carton 1000, the front panel 100 may be spaced a distance D3 of about 4 inches from the first and second panels 400, 500. Such expansion of the pouch 1010 may be achieved, for example, through expansion of the food product F (e.g., in the case of popcorn kernels, the popping and expansion of the kernels) and/or through convection currents in association with a heating process and the expansion of the heated air within the pouch 1010. In alternate embodiments, the front panel 100 and the first and second panels 400, 500 may be moved away from one another prior to heating, for example, by manually pulling on the carton 1000.

In this regard, the erected carton 1000 in the second, expanded configuration is provided. In the expanded configuration of the carton 1000 shown, one or more of panels 100, 200, 300, 400, 500 and/or one or more of the end flaps 110, 120 provide the structure 1028 with an at least partially rigid configuration such that the pouch 1010 is maintained in an upright or otherwise desired position, for example, so that the carton 1000 may be supported in an upright position on a surface without the pouch 1010 falling over or spilling. In this regard, the carton 1000 in the second, expanded configuration can be positioned in an upright condition after heating, and lower edge portions of at least the front panel 100 and the first and second rear panels 400, 500 that extend below the first and second side panels 200, 300 may define a base 1018 to provide stability for the carton 1000 in the second, expanded configuration in an upright condition. The end 1020 of the pouch 1010 may be opened, for example, by tearing and/or separating portions of the liner 1006, to provide access to the interior 1011 of the carton 1000. Additionally, the presence of the one or more of panels 100, 200, 300, 400, 500 and/or one or more of the end flaps 110, 120 about the pouch 1010 provides a convenient surface for grasping and holding the pouch 1010 and which may insulate a user's hands, body, and/or clothing, for example, from heat or food particles (e.g., liquid portions of food product F or condiments applied thereto that soak through the liner 1006). As described herein, the carton 1000 together with the pouch 1010 can be referred to as a package 1008 according to the present disclosure, and which can together be provided in the expanded configuration shown or an unexpanded configuration as described above. While the carton 1000 and the package 1008 have been described herein as including the liner 1006 and/or the pouch 1010, it will be understood that the carton 1000 and the package 1008 can be provided independently of the liner 1006 and/or the pouch 1010 without departing from the disclosure.

Figure 9:
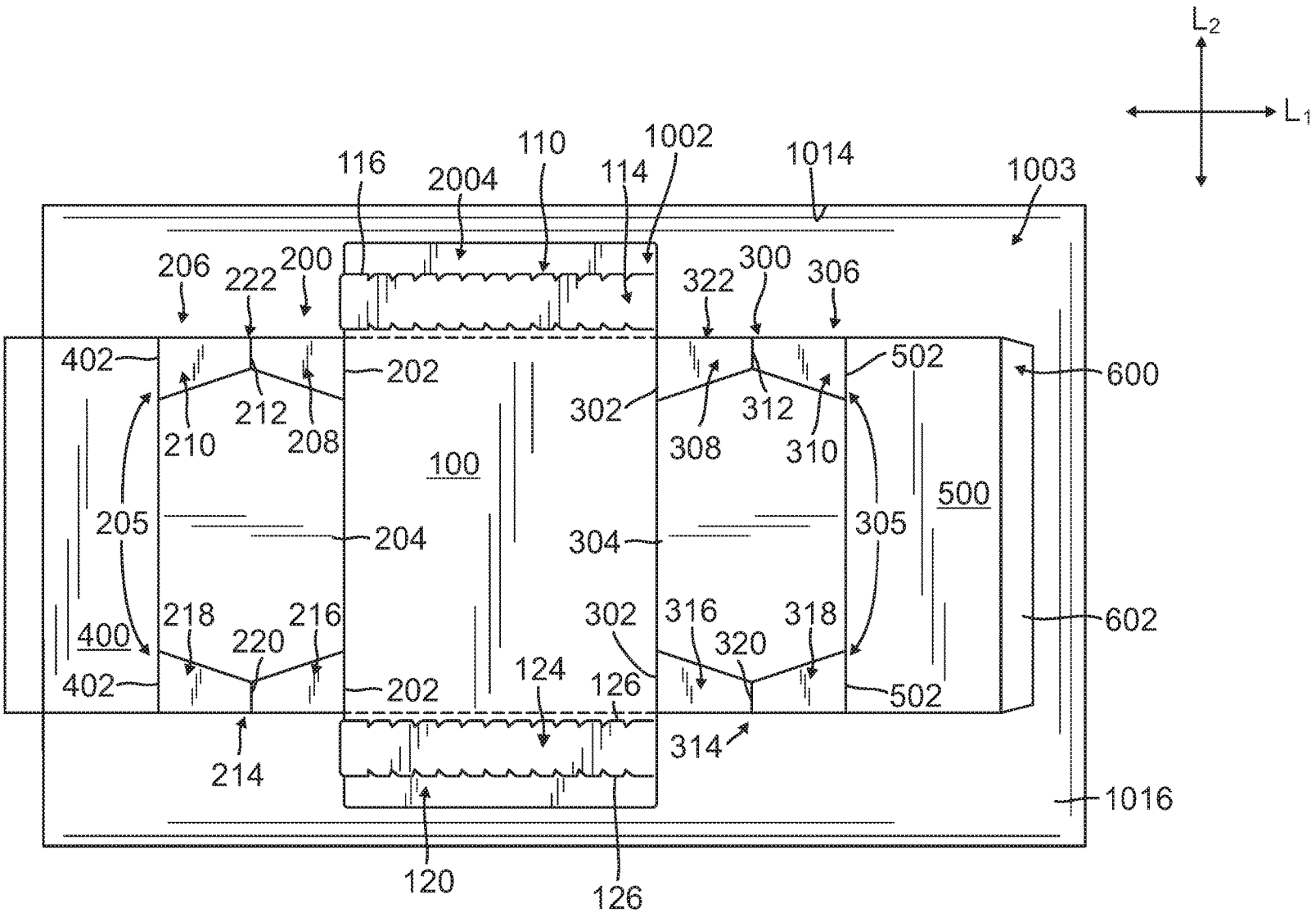
FIG. 9 is a plan view of a carton blank and liner for forming a package or a carton according to a second exemplary embodiment of the disclosure.

Turning to FIG. 9, a second exemplary embodiment of a blank 2004 with a liner 1006 for forming a package and carton is illustrated. The blank 2004 may have substantially similar features to the blank 1004 (FIG. 1) of the first exemplary embodiment of the disclosure, with like components designated with like or similar reference numbers. In the illustrated second embodiment, the end flaps 110, 120 may be provided with a substantially similar length along the lateral axis L2. As also shown, the upper portions 206, 306 of the respective first side panel 200 and the second side panel 300 may have a substantially similar length along the lateral axis L2 to the respective lower portions 210, 310 of the respective first side panel 200, 300. Further, the respective upper portions 206, 306 and the respective lower portions 210, 310 of the respective first side panel 200 and the second side panel 300 have a symmetry about the longitudinal axis L1 such that the front panel sections 216, 316 and the rear panel sections 218, 318 have a lower edge that is collinear with the lower edge of the rear panels 400, 500. In one embodiment, the blank 2004 and liner 1006 can include a susceptor.

A blank according to the present disclosure can be, for example, formed from coated paperboard and similar materials. For example, the interior and/or exterior sides of the blank can be coated with a clay coating. The clay coating may then be printed over with product, advertising, price coding, and other information or images. The blank may then be coated with a varnish to protect any information printed on the blank. The blank may also be coated with, for example, a moisture barrier layer, on either or both sides of the blank. In accordance with the above-described embodiments, the blank may be constructed of paperboard of a caliper such that it is heavier and more rigid than ordinary paper. The blank can also be constructed of other materials, such as cardboard, hard paper, or any other material having properties suitable for enabling the package to function at least generally as described herein. The blank can also be laminated or coated with one or more sheet-like materials at selected panels or panel sections.

In accordance with the above-described embodiments of the present disclosure, a fold line can be any substantially linear, although not necessarily straight, form of weakening that facilitates folding therealong. More specifically, but not for the purpose of narrowing the scope of the present disclosure, fold lines may include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

The above embodiments may be described as having one or more panels adhered together by glue during erection of the package embodiments. The term "glue" is intended to encompass all manner of adhesives commonly used to secure package panels in place.

The foregoing description illustrates and describes various embodiments of the present disclosure. As various changes could be made in the above construction, it is intended that all matter contained in the above description or shown in the accompanying drawings shall be interpreted as illustrative and not in a limiting sense. Furthermore, the present disclosure covers various modifications, combinations, and alterations, etc., of the above-described embodiments that are within the scope of the claims. Additionally, the disclosure shows and describes only selected embodiments, but various other combinations, modifications, and environments are within the scope of the disclosure as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for holding a product in a liner, the carton comprising:

a plurality of panels extending at least partially around an interior of the carton, the plurality of panels comprising a front panel, at least one rear panel, and at least one side panel, at least one end flap foldably connected to a respective panel of the plurality of panels, the at least one side panel comprises a first side panel foldably connected to the front panel and a second side panel foldably connected to the front panel, the at least one rear panel comprises a first rear panel foldably connected to the first side panel and a second rear panel foldably connected to the second side panel; and the at least one side panel comprises at least one expansion feature configured to transition the carton between a first configuration and a second configuration, the first configuration is an unexpanded configuration of the carton and the second configuration is an expanded configuration, the at least one expansion feature is foldably connected to the front panel and the at least one rear panel, the at least one expansion feature comprises a first expansion feature in the first side panel comprising at least one front section foldably connected to the front panel and at least one rear section foldably connected to the at least one front section and the first rear panel, and a second expansion feature in the second side panel comprising at least one front section foldably connected to the front panel and at least one rear section foldably connected to the at least one front section of the second side panel and the second rear panel, the at least one front section of the first side panel comprises a first front section and a second front section, and the at least one rear section of the first side panel comprises a first rear section and a second rear section, the first front section of the first side panel is foldably connected to the first rear section of the first side panel and the second front section of the first side panel is foldably connected to the second rear section of the first side panel, and wherein the at least one front section of the second side panel comprises a first front section and a second front section, and the at least one rear section of the second side panel comprises a first rear section and a second rear section, the first front section of the second side panel is foldably connected to the first rear section of the second side panel and the second front section of the second side panel is foldably connected to the second rear section of the second side panel;

the first rear panel and the second rear panel are in at least partial overlapping relation, and the at least one end flap comprises a top end flap foldably connected to the front panel and a bottom end flap foldably connected to the front panel, the top end flap is in at least partial face-to-face contact with the first rear panel and the second rear panel to close a top end of the carton in the unexpanded configuration of the carton and the bottom end flap is in at least partial face-to-face contact with the first rear panel and the second rear panel to close a bottom end of the carton in the unexpanded configuration of the carton, the carton is inhibited from expanding from the unexpanded configuration to the expanded configuration when the top end and the bottom end are closed.

2. The carton of claim 1, wherein in the first configuration, the front panel is spaced a first distance from the at least one rear panel, and in the second configuration, the front panel is spaced a second distance from the at least one rear panel, the second distance is greater than the first distance.

3. The carton of claim 1, wherein a first aperture is disposed between the first front section and the second front section of the first side panel, and the first aperture is disposed between the first rear section and the second rear section of the first side panel, a second aperture is disposed between the first front section and the second front section of the second side panel, and the first aperture is disposed between the first rear section and the second rear section of the second side panel.

4. The carton of claim 1, wherein the top end flap comprises a first opening feature and the bottom end flap comprises a second opening feature.

5. The carton of claim 4, wherein the first opening feature is a tear strip defined by at least one tear line in the top end flap and the second opening feature is a tear strip defined by at least one tear line in the bottom end flap.

6. The carton of claim 4, wherein the first opening feature is removable from a remainder of the top end flap to open the top end of the carton, the second opening feature is removable from a remainder of the bottom end flap to open the bottom end of the carton.

7. The carton of claim 1, wherein edge portions of each of the first side panel, the second side panel, the first rear panel, and the second rear panel define a base of the carton.

8. The carton of claim 1 in combination with the liner, wherein the liner is configured to form a pouch with at least one closed end.

9. The combination of claim 8, wherein the carton comprises a support structure that supports the pouch.

10. The combination of claim 8, wherein the liner comprises at least one microwave energy interactive material.

11. The combination of claim 10, wherein the at least one microwave energy interactive material is a susceptor.

12. A blank for forming a carton for holding a product in a liner, the blank comprising:

a plurality of panels for extending at least partially around the carton formed from the blank, the plurality of panels comprising a front panel, at least one rear panel, and at least one side panel, at least one end flap foldably connected to a respective panel of the plurality of panels, the at least one side panel comprises a first side panel foldably connected to the front panel and a second side panel foldably connected to the front panel, the at least one rear panel comprises a first rear panel foldably connected to the first side panel and a second rear panel foldably connected to the second side panel; and the at least one side panel comprises at least one expansion feature configured to transition the carton between a first configuration and a second configuration when the carton is formed from the blank, the first configuration is an unexpanded configuration of the carton and the second configuration is an expanded configuration, the at least one expansion feature is foldably connected to the front panel and the at least one rear panel, the at least one expansion feature comprises a first expansion feature in the first side panel comprising at least one front section foldably connected to the front panel and at least one rear section foldably connected to the at least one front section and the first rear panel, and a second expansion feature in the second side panel comprising at least one front section foldably connected to the front panel and at least one rear section foldably connected to the at least one front section of the second side panel and the second rear panel, the at least one front section of the first side panel comprises a first front section and a second front section, and the at least one rear section of the first side panel comprises a first rear section and a second rear section, the first front section of the first side panel is foldably connected to the first rear section of the first side panel and the second front section of the first side panel is foldably connected to the second rear section of the first side panel, and wherein the at least one front section of the second side panel comprises a first front section and a second front section, and the at least one rear section of the second side panel comprises a first rear section and a second rear section, the first front section of the second side panel is foldably connected to the first rear section of the second side panel and the second front section of the second side panel is foldably connected to the second rear section of the second side panel;

the first rear panel and the second rear panel are in at least partial overlapping relation in the carton formed from the blank, and the at least one end flap comprises a top end flap foldably connected to the front panel and a bottom end flap foldably connected to the front panel, the top end flap is in at least partial face-to-face contact with the first rear panel and the second rear panel to close a top end of the carton formed from the blank in the unexpanded configuration of the carton and the bottom end flap is in at least partial face-to-face contact with the first rear panel and the second rear panel to close a bottom end of the carton formed from the blank in the unexpanded configuration of the carton, the carton is inhibited from expanding from the unexpanded configuration to the expanded configuration when the top end and the bottom end are closed.

13. The blank of claim 12, wherein in the first configuration, the front panel is spaced a first distance from the at least one rear panel, and in the second configuration, the front panel is spaced a second distance from the at least one rear panel, the second distance is greater than the first distance.

14. The blank of claim 12, wherein a first aperture is disposed between the first front section and the second front section of the first side panel, and the first aperture is disposed between the first rear section and the second rear section of the first side panel, a second aperture is disposed between the first front section and the second front section of the second side panel, and the first aperture is disposed between the first rear section and the second rear section of the second side panel.

15. The blank of claim 12, wherein the top end flap comprises a first opening feature and the bottom end flap comprises a second opening feature.

16. The blank of claim 15, wherein the first opening feature is a tear strip defined by at least one tear line in the top end flap and the second opening feature is a tear strip defined by at least one tear line in the bottom end flap.

17. The carton of claim 15, wherein the first opening feature is removable from a remainder of the top end flap to open the top end of the carton formed from the blank, the second opening feature is removable from a remainder of the bottom end flap to open the bottom end of the carton formed from the blank.

18. The carton of claim 12, wherein edge portions of each of the first side panel, the second side panel, the first rear panel, and the second rear panel define a base of the carton formed from the blank.

19. The blank of claim 12 in combination with the liner, wherein the liner is configured to form a pouch with at least one closed end when the carton is formed from the blank.

20. The blank of claim 19, wherein the carton formed from the blank comprises a support structure that supports the pouch when the pouch is formed from the liner.

21. The combination of claim 19, wherein the liner comprises at least one microwave energy interactive material.

22. The combination of claim 21, wherein the at least one microwave energy interactive material is a susceptor.

23. A method of forming a carton for holding a product in a liner, the method comprising:

providing a blank, the blank comprising a plurality of panels comprising a front panel, at least one rear panel, and at least one side panel, the at least one side panel comprises a first side panel foldably connected to the front panel and a second side panel foldably connected to the front panel, the at least one rear panel comprises a first rear panel foldably connected to the first side panel and a second rear panel foldably connected to the second side panel the at least one side panel comprises at least one expansion feature foldably connected to the front panel and the at least one rear panel, the blank further comprising at least one end flap foldably connected to a respective panel of the plurality of panels;

folding the plurality of panels at least partially around an interior of the carton such that the carton is provided in one of a first configuration and a second configuration, the at least one expansion feature is configured to transition the carton between the first configuration and the second configuration, the first configuration is an unexpanded configuration of the carton and the second configuration is an expanded configuration, the at least one expansion feature comprises a first expansion feature in the first side panel comprising at least one front section foldably connected to the front panel and at least one rear section foldably connected to the at least one front section and the first rear panel, and a second expansion feature in the second side panel comprising at least one front section foldably connected to the front panel and at least one rear section foldably connected to the at least one front section of the second side panel and the second rear panel, the at least one front section of the first side panel comprises a first front section and a second front section, and the at least one rear section of the first side panel comprises a first rear section and a second rear section, the first front section of the first side panel is foldably connected to the first rear section of the first side panel and the second front section of the first side panel is foldably connected to the second rear section of the first side panel, and wherein the at least one front section of the second side panel comprises a first front section and a second front section, and the at least one rear section of the second side panel comprises a first rear section and a second rear section, the first front section of the second side panel is foldably connected to the first rear section of the second side panel and the second front section of the second side panel is foldably connected to the second rear section of the second side panel;

the folding the plurality of panels comprises positioning the first rear panel and the second rear panel in at least partial overlapping relation;

the at least one end flap comprises a top end flap foldably connected to the front panel and a bottom end flap foldably connected to the front panel, the method comprises closing a top end of the carton in the unexpanded configuration of the carton by positioning the top end flap in at least partial face-to-face contact with the first rear panel and the second rear panel, and closing a bottom end of the carton in the unexpanded configuration of the carton by positioning the bottom end flap in at least partial face-to-face contact with the first rear panel and the second rear panel, the closing the top end of the carton and the closing the bottom end of the carton inhibit the carton from expanding from the unexpanded configuration to the expanded configuration.

24. The method of claim 23, wherein in the first configuration, the front panel is spaced a first distance from the at least one rear panel, and in the second configuration, the front panel is spaced a second distance from the at least one rear panel, the second distance is greater than the first distance.

25. The method of claim 23, wherein a first aperture is disposed between the first front section and the second front section of the first side panel, and the first aperture is disposed between the first rear section and the second rear section of the first side panel, a second aperture is disposed between the first front section and the second front section of the second side panel, and the first aperture is disposed between the first rear section and the second rear section of the second side panel.

26. The method of claim 23, wherein the at least one top end flap comprises a first opening feature and the bottom end flap comprises a second opening feature.

27. The method of claim 26, wherein the first opening feature is a tear strip defined by at least one tear line in the top end flap and the second opening feature is a tear strip defined by at least one tear line in the bottom end flap.

28. The method of claim 26, wherein the first opening feature is removable from a remainder of the top end flap to open the top end of the carton, the second opening feature is removable from a remainder of the bottom end flap to open the bottom end of the carton.

29. The method of claim 23, wherein edge portions of each of the first side panel, the second side panel, the first rear panel, and the second rear panel define a base of the carton.

30. The method of claim 23, further comprising providing the liner and further comprising forming a pouch with at least one closed end.

31. The method of claim 30, wherein the carton comprises a support structure that supports the pouch.

32. The method of claim 30, wherein the liner comprises at least one microwave energy interactive material.

33. The method of claim 32, wherein the at least one microwave energy interactive material is a susceptor.

34. The method of claim 23, further comprising transitioning the carton from the first configuration to the second configuration.

* * * * *